US008774665B2

(12) United States Patent
Okano et al.

(10) Patent No.: US 8,774,665 B2
(45) Date of Patent: Jul. 8, 2014

(54) IMAGE FORMING APPARATUS AND HEATING METHOD FOR FIXATION SECTION OF THE SAME

(75) Inventors: Tetsuya Okano, Anjo (JP); Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 303 days.

(21) Appl. No.: 13/270,478

(22) Filed: Oct. 11, 2011

(65) Prior Publication Data

US 2012/0163848 A1 Jun. 28, 2012

(30) Foreign Application Priority Data

Dec. 28, 2010 (JP) ..... 2010-292085

(51) Int. Cl.
*G03G 15/20* (2006.01)

(52) U.S. Cl.
USPC ..... 399/69; 399/67; 399/68; 399/70

(58) Field of Classification Search
CPC ..... G03G 15/205
USPC ..... 399/67, 68, 69, 70
See application file for complete search history.

(56) References Cited

U.S. PATENT DOCUMENTS

| | | | | |
|---|---|---|---|---|
| 4,937,600 | A | 6/1990 | Hirabayashi et al. | |
| 6,175,699 | B1 | 1/2001 | Kato et al. | |
| 6,438,335 | B1 * | 8/2002 | Kinouchi et al. | 399/67 |
| 2010/0034548 | A1 * | 2/2010 | Naitoh et al. | 399/69 |

FOREIGN PATENT DOCUMENTS

| | | | |
|---|---|---|---|
| JP | 62-115471 | A | 5/1987 |
| JP | 64-072188 | A | 3/1989 |
| JP | 07-248695 | | 9/1995 |
| JP | 11-352825 | | 12/1999 |
| JP | 2000-338801 | | 12/2000 |
| JP | 2001-027864 | | 1/2001 |
| JP | 2001-154530 | A | 6/2001 |
| JP | 2004-348036 | | 12/2004 |
| JP | 2005-292569 | A | 10/2005 |

OTHER PUBLICATIONS

JP Office Action dtd Jan. 17, 2012, JP Appln. 2010-292085, English translation.

* cited by examiner

*Primary Examiner* — Ryan Walsh
(74) *Attorney, Agent, or Firm* — Banner & Witcoff, Ltd.

(57) ABSTRACT

An image forming apparatus includes: an image forming section; a fixation section having a heating mechanism and a roller arranged to face the heating mechanism; a temperature detector for detecting temperature of the fixation section; and a controller for performing a first heating-control in a first heating mode to raise the temperature of the fixation section at a first changing rate, and a second heating-control in a second heating mode to change the temperature of the fixation section at a second changing rate lower than the first changing rate upon rotating the roller when the temperature of the fixation section has reached an intermediate target temperature. The controller performs the first and second heating-controls, respectively, at the time of startup of the fixation section at least once until the temperature of the fixation section reaches a final target temperature.

16 Claims, 6 Drawing Sheets

IMAGE FORMING APPARATUS AND HEATING METHOD FOR FIXATION SECTION OF THE SAME

CROSS REFERENCE TO RELATED APPLICATION

The present application claims priority from Japanese Patent Application No. 2010-292085, filed on Dec. 28, 2010, the disclosure of which is incorporated herein by reference in its entirety.

BACKGROUND OF THE INVENTION

1. Field of the Invention

The present invention relates to an image forming apparatus and, in particular, to a technique with respect to heating control at the time of startup of a fixation section of the image forming apparatus.

2. Description of the Related Art

Regarding an image forming apparatus, as a conventional technique for heating control at the time of startup of a fixation section, for example, the following technique is disclosed in Japanese Patent Application Laid-Open No. 2004-348036. When the initial temperature is lower than or equal to T[1] at the time of startup of a ceramic heater which is a heating mechanism of the fixation section, a controller of the image forming apparatus turns on only the heater of the fixation section. Then, when no change in temperature can be observed after a predetermined period of time has elapsed, the controller judges the temperature detection element to be malfunctioning, for example, and rotates a pressure roller for a predetermined period of time after turning off the heater.

SUMMARY OF THE INVENTION

In such a case, it is possible to lessen the ununiformity of temperature distribution biased to specific places of the fixation section (the bias toward a fixation film and the pressure roller) and caused by energizing the heater while the temperature detection element is malfunctioning. As a result, it is possible to reduce thermal degradation in the specific places of the fixation section. However, when the initial temperature is lower than or equal to T[1] at the time of startup, the controller controls the heating mechanism to heat without rotating the pressure roller of the fixation section, and controls the heating mechanism to switch to a PI control after the initial temperature becomes higher than T[1]. Therefore, at the time of startup of the fixation section, the bias of temperature distribution toward the specific places of the fixation section is enhanced. Further, the aforementioned document does not disclose as to whether or not the heating mechanism can be changed to an energizing control such as to stop energizing the heater of the fixation section, etc., until being switched to the PI control.

In view of the above situation, an object of the present invention is to provide a technique capable of changing the state of the heating-control of the fixation section while lessening the bias of temperature distribution toward the specific places of the fixation section at the time of startup of the fixation section.

According to a first aspect of the present invention, there is provided which fixes an developer to form an image on a recording medium, the apparatus including:

an image forming section which places the developer on the recording medium to form the image thereon;

a fixation section which fixes the developer placed on the recording medium, having a heating mechanism which heats the developer placed on the recording medium and a roller which is arranged to face the heating mechanism to form a nip portion at which the recording medium is nipped between the roller and the heating mechanism;

a temperature detector which detects a temperature of the fixation section; and a controller which controls the heating mechanism in a first heating-control in which the heating mechanism is controlled in a first heating mode in which a detection temperature detected by the temperature detector is raised at a first changing rate, and a second heating-control in which, under a condition that the detection temperature has reached an intermediate target temperature, the heating mechanism is controlled in a second heating mode in which the detection temperature is changed at a second changing rate lower than the first changing rate upon rotating the roller, wherein the controller controls the heating mechanism at least once until the detection temperature reaches a final target temperature at a time of startup of the fixation section.

According to a second aspect of the present invention, there is provided a heating method of a fixation section of an image forming apparatus at a time of startup of the fixation section which fixes the developer placed on the recording medium and has a heating mechanism which heats a recording medium on which a developer is placed to form an image, and a roller arranged to face the heating mechanism to form a nip portion in which the recording medium is nipped between the roller and the heating mechanism, the heating method including the steps of:

detecting temperature of the fixation section;

controlling the heating mechanism in a first heating mode in which the temperature detected in the step of detecting temperature is raised at a first changing rate; and controlling the heating mechanism in a second heating mode in which the temperature detected in the step of detecting temperature is changed at a second changing rate lower than the first changing rate upon rotating the roller, under a condition that the temperature detected in the step of detecting temperature has reached an intermediate target temperature, wherein the step of controlling the heating mechanism in the first mode and the step of controlling the heating mechanism in the second mode are carried out respectively at least once until the temperature detected in the step of detecting temperature reaches a final target temperature.

According to the first aspect and second aspect of the present invention, at the time of startup of the fixation section, the temperature of the fixation section is controlled to rise to the final target temperature via the intermediate target temperature. When the temperature of the fixation section has reached the intermediate target temperature, the second heating control is carried out at least once for controlling the heating mechanism in the second heating mode to reduce the change rate of the detection temperature while rotating the roller. By carrying out the second heating control in such a manner, it is possible to rotate the roller in a state of diminishing the temperature rise of the fixation section, namely, changing the heating control condition for the fixation section. Therefore, at the time of startup of the fixation section, it is possible to change the heating control condition for the fixation section while reducing the bias of temperature distribution toward a specific place of the fixation section (the roller).

According to a third aspect of the present invention, there is provided an image forming apparatus which fixes an developer to form an image on a recording medium, the apparatus including:

an image forming section which places the developer on the recording medium to form the image thereon;

a fixation section which fixes the developer placed on the recording medium, having a heating mechanism which heats the developer placed on the recording medium and a roller arranged to face the heating mechanism to form a nip portion at which the recording medium is nipped between the roller and the heating mechanism;

a motor connected to the roller to rotate the roller; and a controller which controls the motor and the heating mechanism to perform a first control in which the heating mechanism is controlled to heat with a first output upon stopping the motor, and a second control in which the heating mechanism is controlled to heat with a second output smaller than the first output upon driving the motor, wherein the controller controls the motor and the heating mechanism to perform the first control and the second control respectively, at the time of startup of the fixation section at least once until the fixation section reaches a final target temperature.

In the above case, because the roller is only rotated under the second control, it is possible to reduce the maximum power consumption when operating the heating member and the roller simultaneously. As a result, it is possible to reduce the maximum power consumption of the image forming apparatus.

DESCRIPTION OF THE PREFERRED EMBODIMENTS

Next, with reference to FIGS. 1 to 5, a preferred embodiment of the present teaching will be explained.

1. Overall Configuration of the Printer

Figure 1:
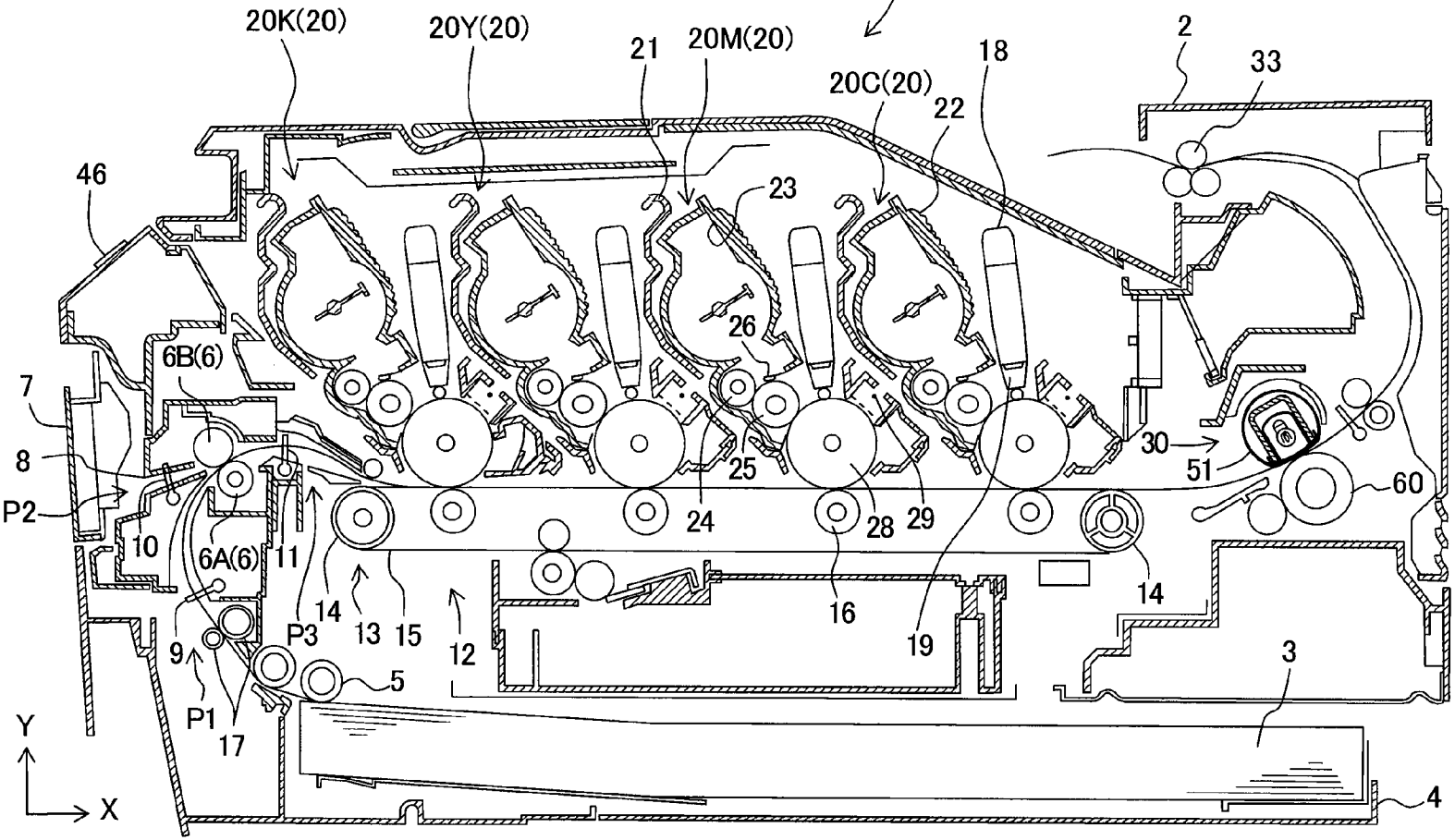
FIG. 1 is a sectional side view showing a schematic configuration of a printer as an example of the image forming apparatus in accordance with the present invention.

A printer 1 is a color LED printer of a direct tandem type utilizing four-color (black K, yellow Y, magenta M, and cyan C) toners to form color images. In the following explanations, the left side in a horizontal direction (an X-axis direction) in FIG. 1 is defined as the front side. Further, in FIG. 1, with respect to the same or equivalent constitutive parts or components for the different colors, reference numerals will be omitted as appropriate. Further, the image forming apparatus is not limited to a color LED printer of a direct tandem type, but may as well be a color laser printer, a monochrome laser printer, or a multifunction printer with a photocopy function and the like.

The printer 1 includes a body casing 2, and a paper feed tray 4 capable of accommodating a plurality of sheets of printing paper 3 (an example of the recording medium) at the bottom in the body casing 2 on the lower side of FIG. 1 in a vertical direction (a Y-axis direction). At the upper side of the front end of the paper feed tray 4, a paper feed roller 5 is provided, and along with the rotation of the paper feed roller 5, the printing paper 3 located at the top in the paper feed tray 4 is sent out to a supply path P1 provided in the front portion inside the body casing 2.

On the supply path P1, there are provided an auxiliary paper feed roller 17, and a resist roller 6 having a driving roller 6A and a driven roller 6B. The driving roller 6A of the resist roller 6 is connected to a paper feed motor 47 via a gear mechanism (not shown), for example, and the driving force of the paper feed motor 47 is thus transmitted to the driving roller 6A.

Further, on the front surface inside the body casing 2, a manual guide 7 is provided to be capable of falling down onto the front side, and on the inside of the manual guide 7, a manual port 8 is opened to allow a user to insert the printing paper 3. The manual port 8 is in communication with the resist roller 6 via a manual path P2 and, furthermore, at the back side of the resist roller 6, a transport path P3 is formed in communication with a belt unit 13 of an image forming section 12.

The resist roller 6 transports the printing paper 3 sent in from the supply path P1 or from the manual path P2 onto the belt unit 13 of the image forming section 12 via the transport path P3. Further, on the supply path P1, the manual path P2, and the transport path P3, there are provided a pre-resisting sensor 9, a manual sensor 10, and a post-resisting sensor 11, respectively. Each of the sensors 9 to 11 detects whether or not the printing paper 3 is present at the respective position.

The image forming section 12 includes the belt unit 13, exposure portions 18, a processing portion 20, and the like. The belt unit 13 includes a loop-shaped belt 15 stretched between a pair of belt support rollers 14 at the front side and the back side. When the belt support roller 14 at the back side rotates, the belt 15 moves cyclically in a clockwise direction shown in the figure, and thereby the printing paper 3 carried on the upper surface of the belt 15 is transported to the back side. Further, four transfer rollers 16 are provided on the inner side of the belt 15.

The four exposure portions 18 and the processing portion 20 are provided at the upper side of the belt unit 13. Each of the exposure portions 18 includes an LED unit corresponding to one of the respective colors of black, yellow, magenta and cyan, and has an LED head 19 in the lower end portion. Further, the light emission of each of the exposure portions 18 is controlled based on the image data to be generated to irradiate light on the surface of a photosensitive drum 28 from the LED head 19.

The processing portion 20 includes four processing cartridges 20K, 20Y, 20M and 20C corresponding to the aforementioned four colors. Each of the processing cartridges 20K to 20C includes a cartridge frame 21, and a developing cartridge 22 installed on the cartridge frame 21 in a removable manner. Each of the developing cartridges 22 has a toner accommodation chamber 23 for accommodating one of the multicolor toners that is the developer. Further, below the toner accommodation chamber 23, each of the developing cartridges 22 includes a supply roller 24, a developing roller 25, a layer thickness regulation blade 26, and the like.

The toner released from each toner accommodation chamber 23 is supplied to the developing roller 25 by virtue of the rotation of the supply roller 24, and positively charged through triboelectrification (triboelectric charging) between the supply roller 24 and the developing roller 25. Further, along with the rotation of the developing roller 25, the toner supplied onto the developing roller 25 comes between the layer thickness regulation blade 26 and the developing roller 25. Then the toner is further charged sufficiently through triboelectrification, and thereby held on the developing roller 25 as a thin layer with a certain thickness.

In the lower portion of each cartridge frame 21, there are provided the photosensitive drum 28 the surface of which is covered with a positively-charged photosensitive layer, and a charger 29. The photosensitive drum 28 faces to the corresponding transfer roller 16 to form a nip portion therebetween. The belt 15 is intervened between the photosensitive drum 28 and the transfer roller 16. At the time of forming images, the surface of the photosensitive drum 28 is positively charged in a uniform manner by the charger 29. Then, the positively charged portion is exposed by the exposure portion 18, and thus an electrostatic latent image is formed on the surface of the photosensitive drum 28.

Subsequently, the positively charged toner held on the developing roller 25 is supplied to the electrostatic latent image on the surface of the photosensitive drum 28, whereby the electrostatic latent image of the photosensitive drum 28 is made visible. Thereafter, the toner image held on the surface of each photosensitive drum 28 is sequentially transferred onto the printing paper 3 by a transfer voltage of negative polarity applied to the transfer roller 16 while the printing paper 3 is passing through each nip position between the photosensitive drums 28 and the transfer rollers 16.

The printing paper 3 with the transferred toner image is then transported to a fixation device (a fixing device) 30 (corresponding to a fixation section) by the belt unit 13. While the printing paper 3 is passing through the fixation device 30, the toner image transferred on the printing paper 3 is thermally fixed on the paper surface. The printing paper 3 with the toner image thermally fixed by the fixation device 30 is then transported upward, and outputted to the upper surface of the body casing 2 by an output roller 33.

2. A Detailed Configuration of the Fixation Device

Figure 2:
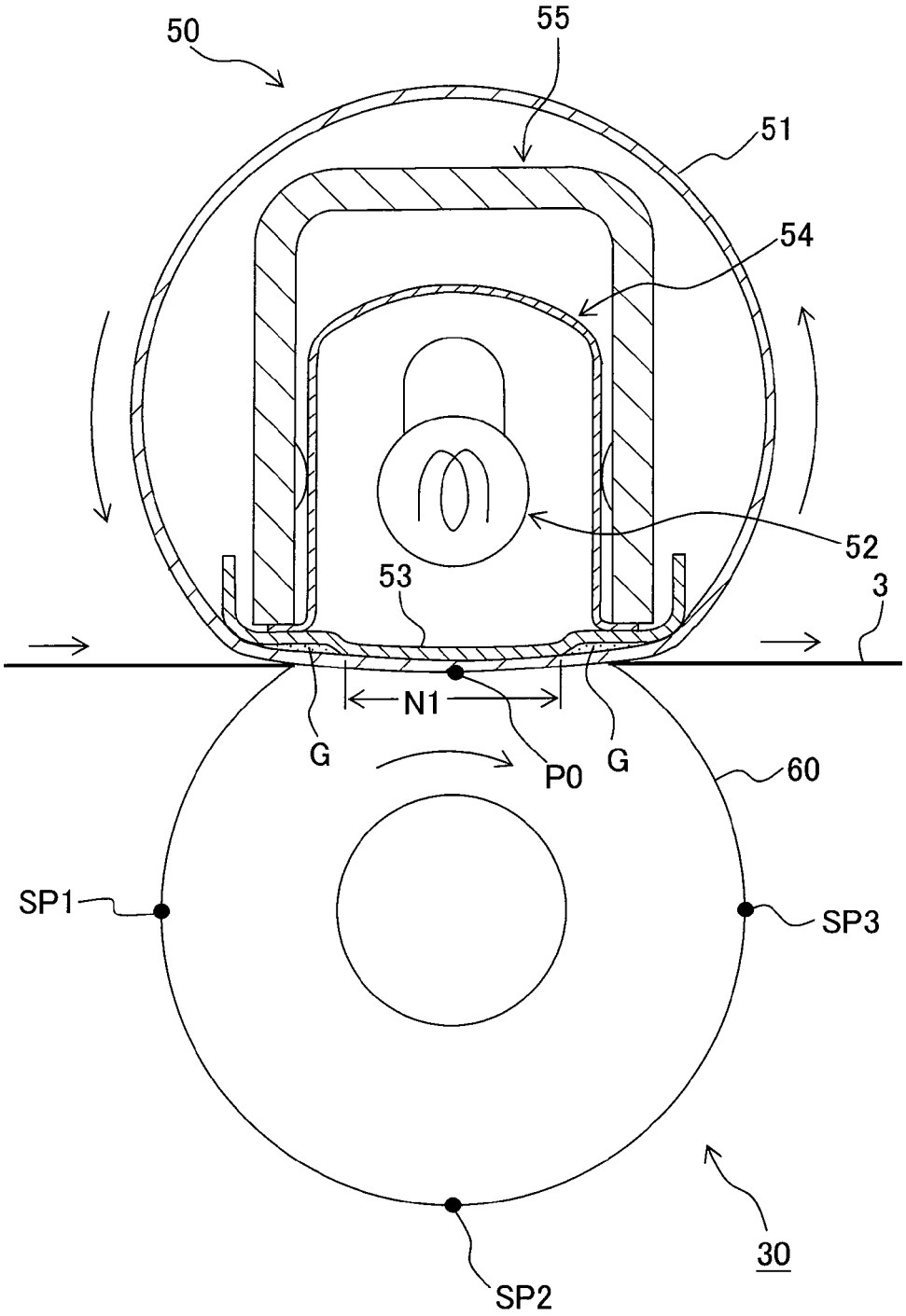
FIG. 2 is a sectional side view showing a schematic configuration of a fixation section.

As shown in FIG. 2, the fixation device 30 has a heating member 50 for applying heat to the printing paper 3, and a pressure roller 60 (a backup member) arranged opposite the heating member 50 to form a nip portion N1 for nipping the printing paper 3 with the heating member 50, so as to fix the image formed on the printing paper 3.

Here, the heating member 50 of the present embodiment is a film fixation type, and thus includes a fixation film 51 (corresponding to a film), a halogen lamp 52 (an example of a heating source), a nip plate 53 (an example of a nip member), a reflector 54, and a stay 55, as shown in FIG. 2. Further, the heating source is not limited to a halogen lamp. For example, it may as well be a ceramic heater or the like. Further, the heating member 50 is not limited to a film fixation type. For example, it may as well be configured by a heating roller including a heating source.

Further, in the following explanations, the transport direction of the printing paper 3 (approximately the front-back direction) will be simply referred to as "transport direction", and the width direction of the printing paper 3 (approximately the left-right direction) will be simply referred to as "width direction". Further, the direction of the pressing force or pressure from the pressure roller 60 (approximately the up-down direction) will be simply referred to as "pressure direction".

The fixation film 51 is a ring-shaped (tubular) film which is heat-resistant and flexible, and both of the end portions in the width direction are retained by a guide member (not shown). By virtue of this, the fixation film 51 is guided in rotation.

The halogen lamp 52 is a known heating element. The halogen lamp 52 is used for heating the toner on the printing paper 3 by heating the nip plate 53 and the fixation film 51, and is arranged inside the fixation film 51 with predetermined intervals from the inner surfaces of the fixation film 51 and nip plate 53.

The nip plate 53 is a plate-shaped member arranged to be in sliding contact with the inner surface of the tubular fixation film 51 for receiving the pressing force from the pressure roller 60 while transmitting the radiation heat from the halogen lamp 52 to the toner on the printing paper 3 via the fixation film 51. The nip plate 53 is formed into an approximate U shape in a cross-sectional view by bending a plate material (an aluminum plate or the like) having a higher thermal conductivity than the steel stay 55 which will be described hereinafter. A lubricant G is retained between the nip plate 53 and the fixation film 51 for application to the fixation film 51. By virtue of the lubricant G the sliding resistance is reduced between the fixation film 51 and the nip plate 53, and thereby it becomes possible to preferably rotate the fixation film 51. Here, as an example of the lubricant G it is possible to adopt heat-resistant fluorine grease.

Further, as shown in FIG. 2, the reflector 54 is a member for reflecting the radiation heat from the halogen lamp 52 (mainly the radiation heat emitted in frontward, backward and upward directions) toward the nip plate 53, and is arranged inside the fixation film 51 with a predetermined interval from the halogen lamp 52 so that the reflector 54 surrounds the halogen lamp 52. The reflector 54 is formed into an approximate U shape by bending a plate material (an aluminum plate or the like) having a high reflectivity for infrared and far infrared rays.

The stay 55 is a member for securing the rigidity of the nip plate 53 by supporting both end portions of the nip plate 53 in the transport direction, and is arranged to have a shape following the outer contour of the reflector 54 (an approximate U shape in a cross-sectional view) so that the stay 55 covers the reflector 54. In this manner, the reflector 54 is formed into the approximate U shape in a cross-sectional view by bending a plate material (a steel plate or the like) having a comparatively high rigidity.

Further, as shown in FIG. 2, the pressure roller 60 forms the nip portion N1 between the pressure roller 60 and the fixation film 51 by nipping the fixation film 51 between the pressure roller 60 and the nip plate 53, and is arranged below the nip plate 53. In more detail, the pressure roller 60 presses the nip plate 53 via the fixation film 51. By virtue of this, the nip portion N1 is formed between the pressure roller 60 and the fixation film 51.

The pressure roller 60 is configured to be driven to rotate by the driving force transmitted from a fixation device motor 31 provided in the body casing 2. As the pressure roller 60 rotates, the fixation film 51 is driven to rotate subordinately by the friction force with the fixation film 51 (or the printing paper 3). While the printing paper 3 with the transferred toner image is being transported between the pressure roller 60 and the heated fixation film 51 (the nip portion N1), the toner image (the toner) is thermally fixed.

3. An Electrical Configuration

Figure 3:
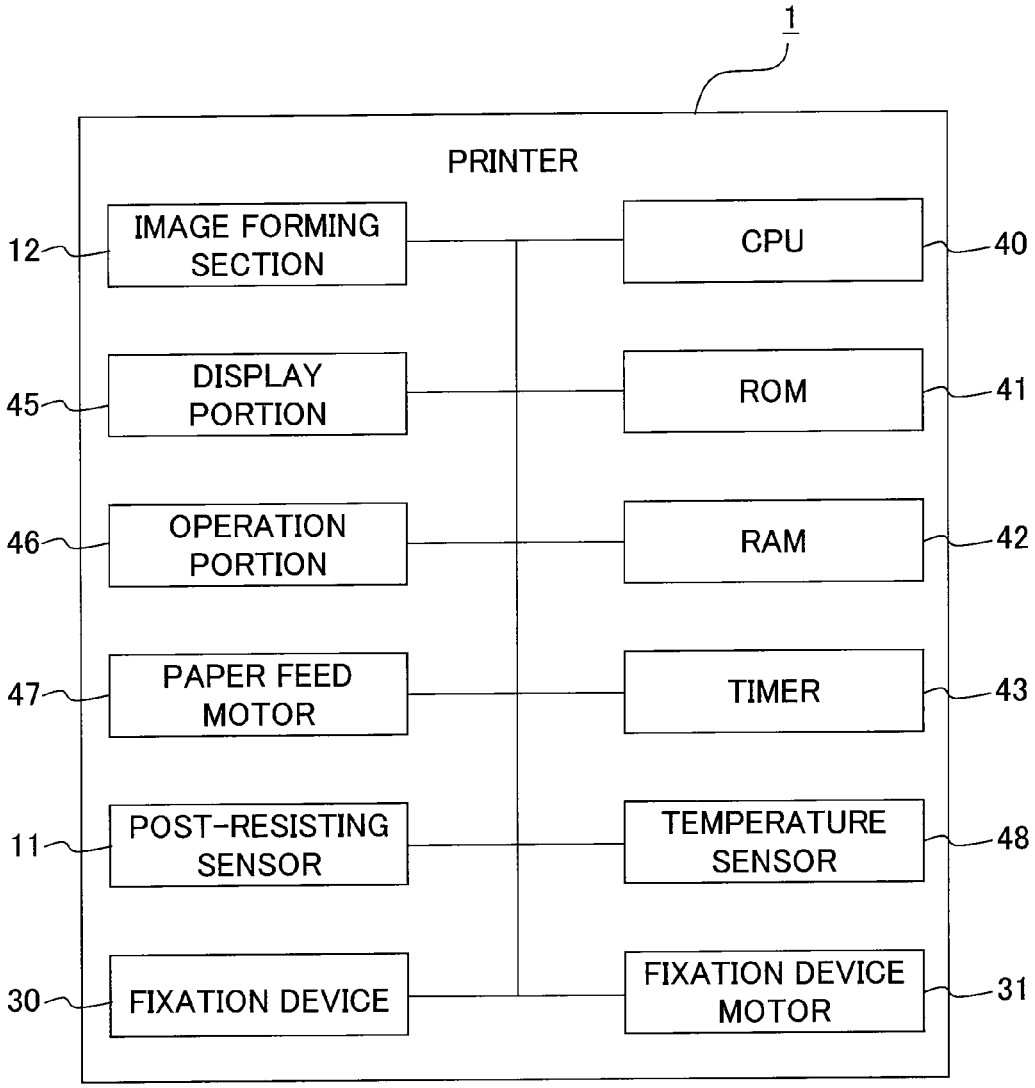
FIG. 3 is a block diagram schematically showing an electrical configuration of the printer.

As shown in FIG. 3, the printer 1 includes a CPU 40 (an example of a control section), a ROM 41, a RAM 42, and an NVRAM (nonvolatile memory). These components are connected with the image forming section 12, the post-resisting sensor 11, the fixation device motor 31, a timer 43, a display portion 45, an operation portion 46, the paper feed motor 47, a temperature sensor 48, and the like.

The display portion 45 includes a liquid crystal display, a lamp, and the like to display various setup screens, operation conditions of the apparatus, various warning messages, and the like. The operation portion 46 includes a plurality of buttons for the user to carry out various input operations.

The ROM 41 has stored various programs, tables, and the like for carrying out operations of the printer 1 such as a heating control process for the fixation device 30 which will be described hereinafter, and the like. The CPU 40 carries out control of each portion with respect to the image forming process such as the heating control process for the fixation device 30 while storing the processing result into the RAM 42 according to the program retrieved from the ROM 41. Further, the temperature sensor 48 is arranged in the vicinity of the fixation device 30 to detect the temperature of the fixation device 30 and supply the CPU 40 with a temperature detection signal according to the detection temperature Td. Further, it is preferable to dispose the temperature sensor 48 on the nip plate 53 so as to detect the temperature of the nip portion N1 of the fixation device 30 with a high degree of accuracy. Based on the detection temperature Td, the CPU 40 carries out the heating control process for the fixation device 30.

4. The Heating Control Process at the Time of Starting Up the Fixation Device

Next, referring to FIGS. 4 and 5, explanations will be made with respect to the heating control process at the time of startup of the fixation device 30 in accordance with the present embodiment. This heating control process is carried out by the CPU 40 according to a predetermined program when, for example, the user makes a printing request to the printer 1 via the operation portion 46. Further, the startup period of the fixation device 30 corresponds to approximately the period from the time t1 to the time t11 of FIG. 5.

Further, in the embodiment, "3" is the target number of heating repetitions n (n is a positive integer), and an example is shown to set three intermediate target temperatures T[1], T[2], and T[3] as the intermediate target temperatures before reaching a final target temperature To of the fixation device 30. Here, the final target temperature To is the temperature at which the fixation device 30 carries out a fixation process. Further, the target number of heating repetitions n is not limited to "3" but may be any numbers greater than or equal to "1". Further, the heating period toward the final target temperature To (from the time t10 to the time t11 of FIG. 5) is supposed to be excluded from the number of heating repetitions. Further, this heating control process may as well be carried out when the user turns on the power to the printer 1 via the operation portion 46. In such a case, the final target temperature To may as well be set to be a predetermined temperature lower than the temperature at which the fixation device 30 carries out the fixation process.

In this heating control process, the CPU 40 controls the heating member 50 by the following first heating control and second heating control. Then, at the time of startup of the fixation device 30, the CPU 40 carries out the first and second heating controls, respectively, at least once until the detection temperature Td reaches the final target temperature. Here, under the first heating control, the CPU 40 controls the heating member 50 in a first heating mode to raise the detection temperature Td according to the temperature sensor 48 toward the intermediate target temperatures T[1], T[2], and T[3] or the final target temperature To. Under the second heating control, the CPU 40 controls the heating member 50 in a second heating mode to reduce the change rate of the detection temperature Td while rotating the pressure roller 60 (the backup member) when the detection temperature Td has reached the intermediate target temperatures T[1], T[2], and T[3]. Here, the periods K1, K3, K5, and K7 correspond to those during which the CPU 40 carries out the first heating control, while the periods K2, K4, and K6 correspond to those during which the CPU 40 carries out the second heating control (see FIG. 5). Further, here, when the detection temperature Td has reached the intermediate target temperatures T[1], T[2], and T[3] due to the first heating control, "reducing the change rate of the detection temperature Td" not only includes reducing a positive change rate of the temperature, that is, reducing the temperature increase rate, but also includes making the change rate of the temperature be "0", that is, keeping the detection temperature Td constant, and making the change rate of the temperature be "negative", that is, decreasing the detection temperature Td.

Further, the example shows that the respective temperatures are set such that the intermediate target temperature T[1]<the intermediate target temperature T[2]<the intermediate target temperature T[3]<the final target temperature To. That is, the intermediate target temperatures T[1], T[2], and T[3] are set in ascending order according to the repetition numbers of the first heating control and the second heating control (see FIG. 5).

In this manner, when the intermediate target temperatures is set to be lower than the final target temperature, it is possible to restrain the fixation device 30 from the deterioration caused by rapid heating, because the fixation device 30 is heated via the intermediate target temperatures. Further, here, each temperature interval between the respectively set temperatures may be either identical to or different from each other. Further, the respective intermediate target temperatures T[1], T[2], and T[3] may as well not be set in ascending order.

Figure 4A:
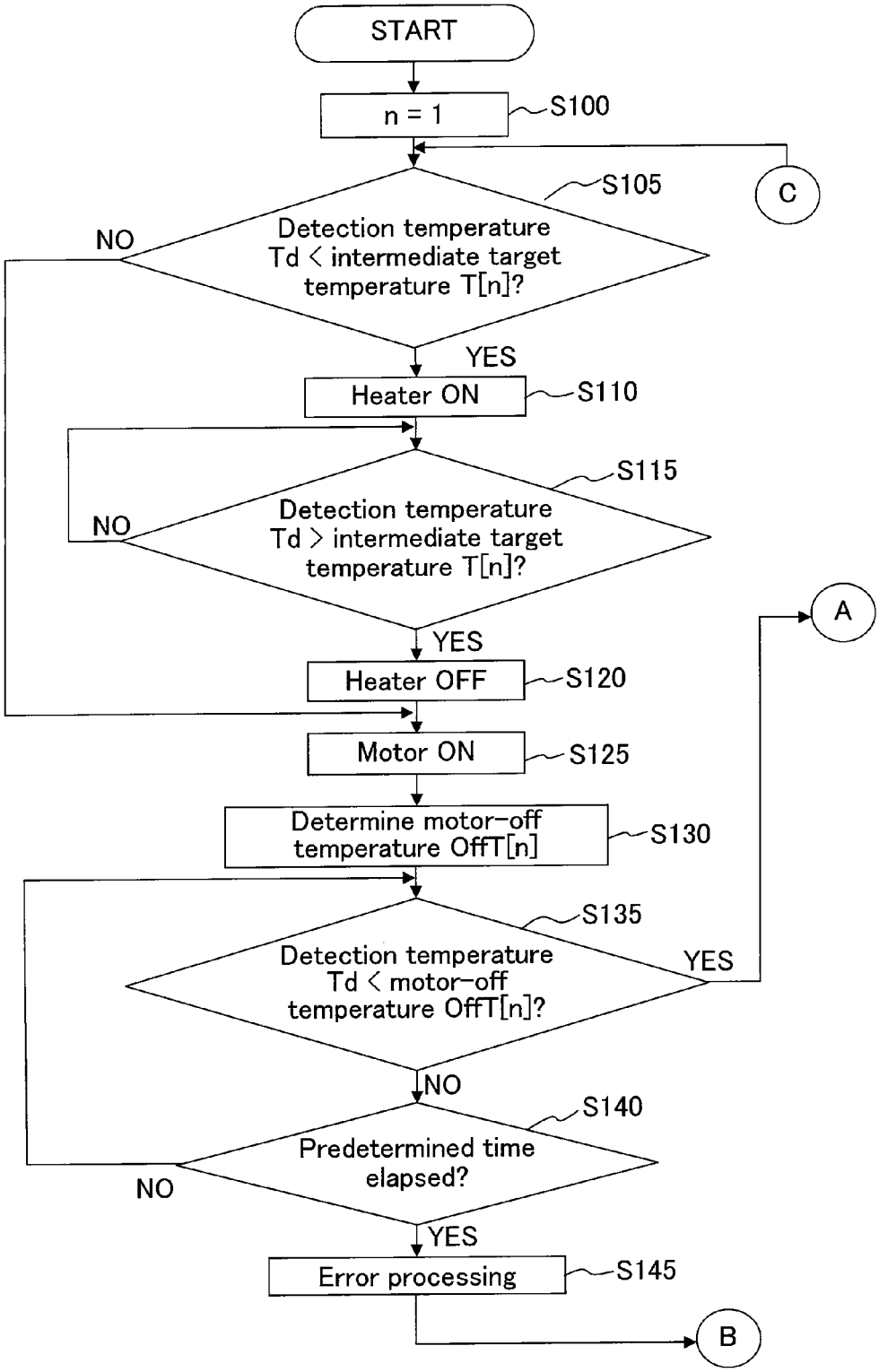
FIGS. 4A and 4B are flowcharts showing a heating process at the time of starting up the fixation section.
Figure 4B:
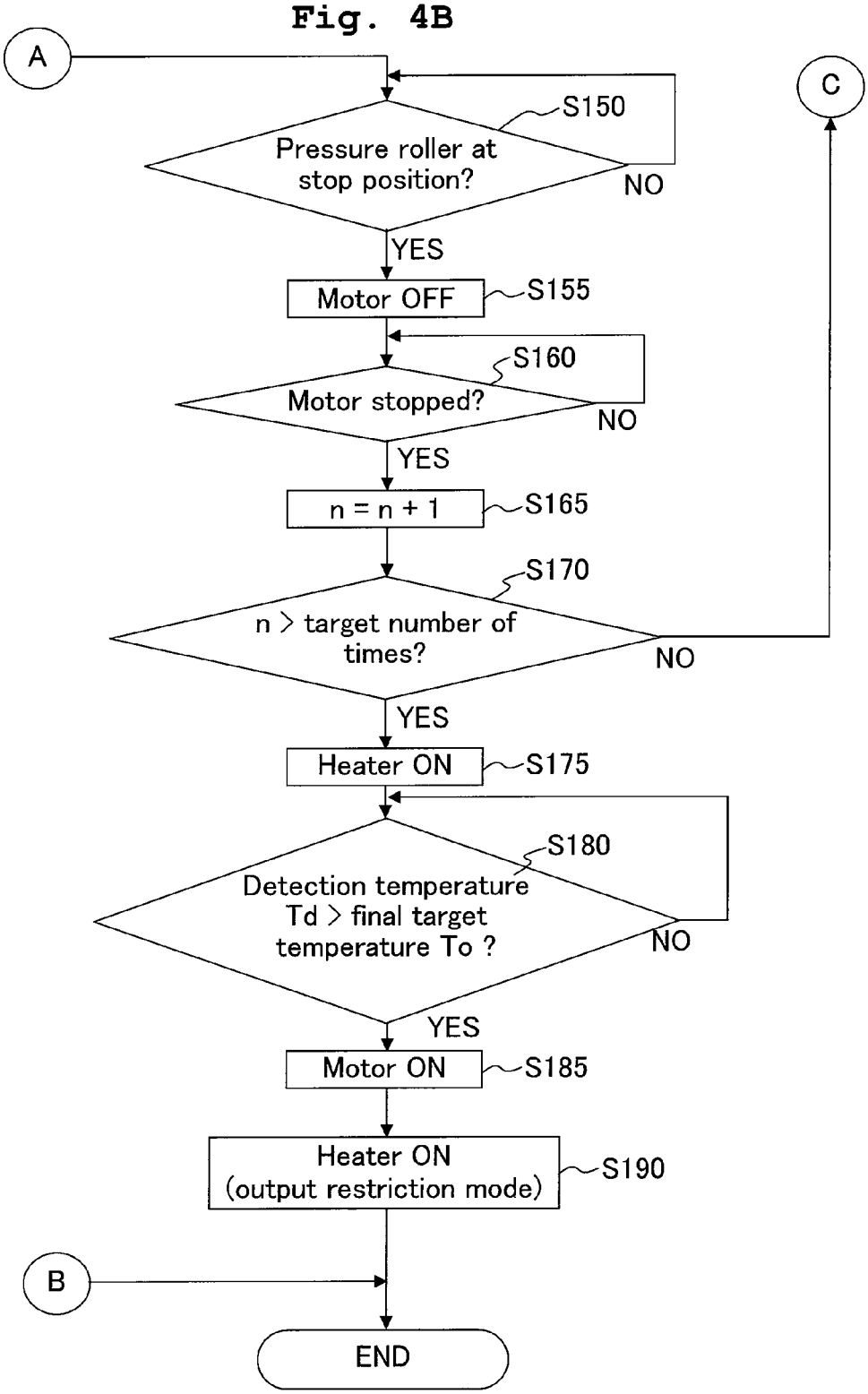
Figure 5:
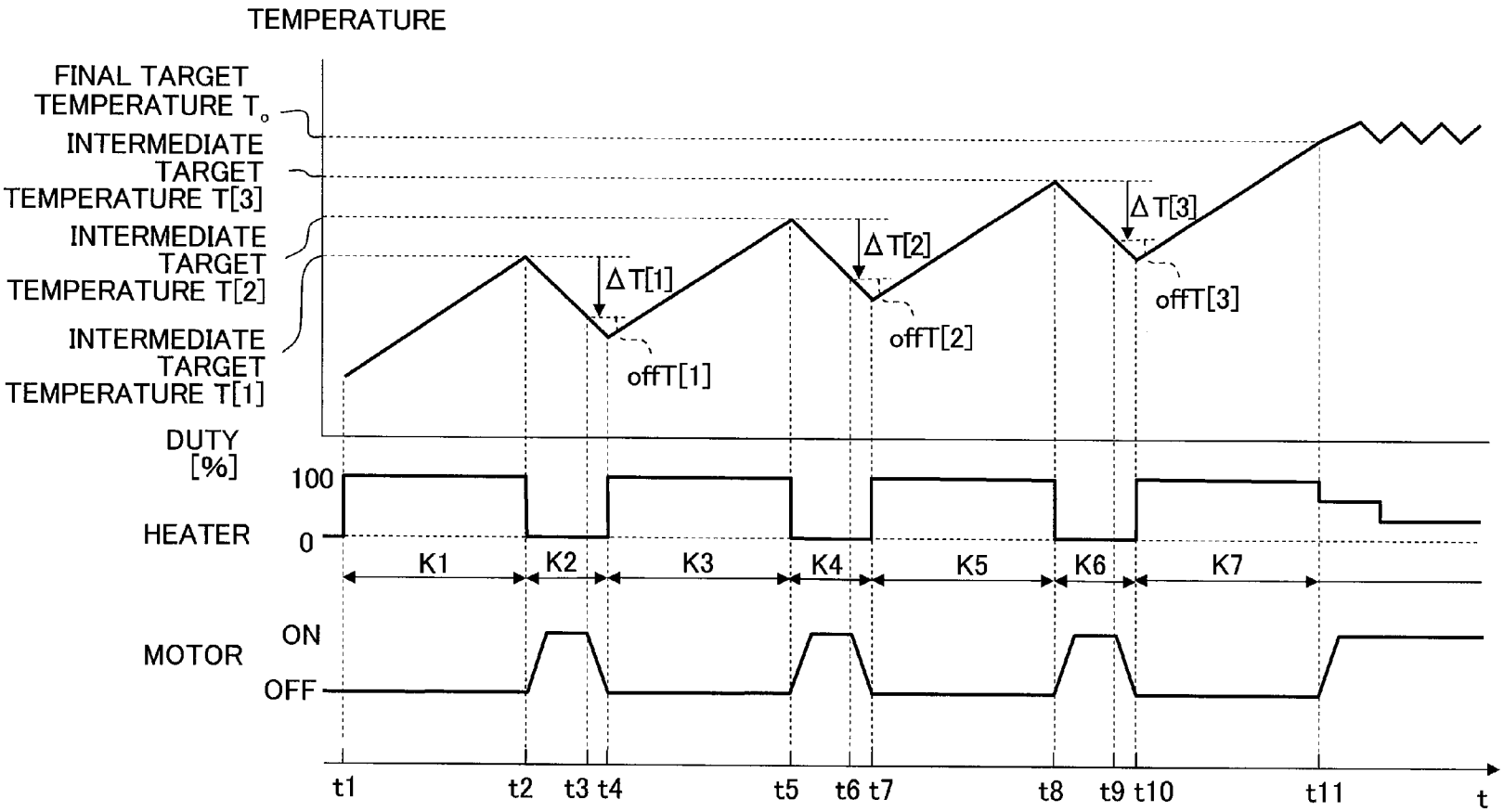
FIG. 5 is a schematic temperature-time graph with respect to the heating process at the time of starting up the fixation section.

Now, assuming that the printing request is made to the printer 1 at the time t1 of FIG. 5, the CPU 40 first sets the number of heating repetitions n (n is a positive integer) to "1" in step S100 in FIG. 4, and then determines whether the detection temperature Td of the temperature sensor 48 is less (lower) than the intermediate target temperature T[n] (the intermediate target temperature T[1] in this case) (step S105).

When the detection temperature Td is determined to be lower than the intermediate target temperature T[1] (step S105: YES), then the CPU 40 turns on the halogen lamp 52 (to be referred to as "heater" hereinbelow) to start heating the heating member 50 (step S110). In this case, the CPU 40 controls the heater 52 by pulse width modulation (PWM) and, with the heater 52 in an ON state (an example of the first heating mode), sets the pulse duty cycle under the PWM control to 100%, for example (see FIG. 5). However, the duty cycle with the heater 52 in an ON state is not limited to 100% but may as well be, for example, 95%, or 85%. Alternatively, the duty cycle with the heater 52 in an ON state may also be variable. That is, it may be any duty cycle as to raise the detection temperature Td toward the intermediate target temperature T[1].

On the other hand, when the detection temperature Td is determined to be not lower than the intermediate target temperature T[1] (step S105: NO), then the process shifts to step S125. This corresponds to a case in which the time interval is not long enough between the previous printing request and the present printing request. In this case, the detection temperature Td has not yet decreased to be lower than or equal to the intermediate target temperature T[1], whereby the process for the period K1 of FIG. 5 is omitted.

Next, the CPU 40 determines whether the detection temperature Td is higher than the intermediate target temperature T[1] (step S115). When the detection temperature Td is determined to be not higher than the intermediate target temperature T[1] (step S115: NO), then the heating is continued with the duty cycle of 100% (corresponding to the period K1 in FIG. 5). On the other hand, when the detection temperature Td is determined to be higher than the intermediate target temperature T[1] (step S115: YES), then the CPU 40 sets the heater 52 to an OFF state (an example of the second heating mode). That is, the CPU 40 stops the power supply to the heater 52 in the second heating mode (step S120). At the same time, the CPU 40 turns on the fixation device motor 31 to rotate the pressure roller 60 (step S125, corresponding to the time t2 in FIG. 5). In this manner, by stopping the power supply to the heater 52, it is possible to preferably lower the detection temperature Td in the second heating mode.

Further, in the second heating mode, although FIG. 5 shows an example of the heater 52 set in an OFF state, namely, a state with the duty cycle set at 0%, the present teaching is not limited to this. For example, in the second heating mode, with the heater 52 set in an ON state, and the duty cycle for this case may as well be set at 5% or 15%. Alternatively, with the heater 52 set in an ON state in the second heating mode, the duty cycle may also be set to be variable. That is, in the second heating mode, the control duty cycle for the heater 52 may be any ratio as to lower the detection temperature Td. Further, during the period K1 in FIG. 5, the fixation device motor 31 is set to be OFF. This is because the fixation device motor 31 would bear a greater load if it were set to be ON before the lubricant G was warmed. Further, setting the fixation device motor 31 to be OFF can also facilitate power saving.

Next, the CPU 40 determines a motor-off temperature OffT [n] (the motor-off temperature OffT[1] in this case) for turning off the fixation device motor 31, that is, the temperature for stopping the rotation of the pressure roller 60 (step S130). Here, the motor-off temperature OffT[1] is set to be, for example, a temperature lower than the intermediate target temperature T[1] by predetermined degrees of temperature ΔT[1].

Next, the CPU 40 determines whether the detection temperature Td is lower than the motor-off temperature OffT [n] (the motor-off temperature OffT[1] in this case) (step S135). When the detection temperature Td is determined to be not lower than the motor-off temperature OffT[1] (step S135: NO), then the CPU 40 determines whether a predetermined period of time has elapsed since the heater-off time (the time t2) (step S140). Here, the predetermined period of time is determined in advance through experiment and the like and, for example, set to be longer than the period K2 shown in FIG. 5.

When it is determined that the predetermined period of time has not yet elapsed since the heater-off time (the time t2) (step S140: NO), then the process returns to step S135. When it is determined that the predetermined period of time has elapsed since the heater-off time (step S140: YES), an error processing is carried out (step S145) because the detection temperature Td does not drop to or below the motor-off temperature OffT[n] (a predetermined temperature) within the predetermined period of time. As the error processing, for example, the CPU 40 may stop driving the fixation device motor 31 and, at the same time, display information of the occurrence of an error with respect to fixation on the display portion 45 to inform the user. It is due to the following reason that an error (abnormality) is detected with respect to fixation.

When the heating member 50 is a film fixation type, it has a small thermal capacity. Therefore, when the heating member 50 is heated in the second heating mode and the pressure roller 60 is in a rotating state, heat is soon taken away by the pressure roller 60. Hence, the detection temperature Td should drop considerably under the second heating control. However, in case the temperature drop is small, these problems or abnormalities are conceivable as the cause: the power supply to the heater 52 cannot be shut off, the temperature sensor 48 malfunctions, the pressure roller 60 rotates abnormally, and the like. Therefore, it is possible to detect abnormalities with respect to fixation by monitoring whether or not the detection temperature Td of the temperature sensor 48 drops predetermined degrees within a predetermined period of time. Further, when the detection temperature Td does not drop under the second heating control, the CPU 40 may as well simply detect it as an abnormality with respect to fixation. In such a case, too, it is still possible to detect abnormalities with respect to fixation by the fact that the detection temperature Td does not drop in the second heating mode for decreasing the detection temperature Td.

On the other hand, when the detection temperature Td is determined to be lower than the motor-off temperature OffT [1] in step S135, the CPU 40 determines whether the pressure roller 60 stays at a predetermined stop position, or in particular, whether a predetermined part of the pressure roller 60 is located in the vicinity of the predetermined stop position (step S150). When the pressure roller 60 does not stay at the predetermined stop position (step S150: NO), then the pressure roller 60 is rotated until it comes to the predetermined stop position. Then, when the pressure roller 60 is determined to be at the predetermined stop position (step S150: YES), the CPU 40 stops driving the fixation device motor 31. In particular, the CPU 40 starts a control process to stop the rotation of the fixation device motor 31 (step S155; at the time t3 of FIG. 5).

Here, the state of the pressure roller 60 shown in FIG. 2 is supposed to be the pressure roller 60 at the position for the time t1. Then, predetermined stop positions of the pressure roller 60 are such ones, for example, as the surface portion SP1 of the pressure roller 60 comes to the approximately central portion P0 of the nip portion N1 for the time t4, the surface portion SP2 comes to the approximately central portion P0 for the time t7, and the surface portion SP3 comes to the approximately central portion P0 for the time t10 (see FIG. 2). That is, during the periods K2, K4, and K6, for example, the pressure roller 60 is rotated through 90 degrees, respectively. At the time, a rotation control is carried out on the fixation device motor 31 from each of the times t3, t6, and t9 such that each of the surface portions SP1, SP2, and SP3 may stop at the approximately central portion P0. However, the rotation angle of the pressure roller 60 is not limited to 90 degrees. The rotation control for the fixation device motor 31 may as well be carried out such that different parts of the pressure roller 60 are to be located at the nip portion N1 by the rotation of the pressure roller 60 during the periods K2, K4, and K6, respectively.

Then, when the fixation device motor 31 is determined to be stopped (step S160: YES; at the time t4 of FIG. 5), then the CPU 40 increments the number of heating repetitions n (step S165), and determines whether it is greater than the target number of heating repetitions ("3" in this case; step S170).

Here, when the number of heating repetitions n is "2" or "3" (step S170: NO), then the process is repeated from step S105 to step S165. That is, in FIG. 5, the times t4 and t7 correspond to the time t1, the times t5 and t8 correspond to the time t2, and the times t6 and t9 correspond to the time t3. Further, the periods K3 and K5 correspond to the period K1, and the periods K4 and K6 correspond to the period K2.

Here, when carrying out the second heating control a number of times, the CPU 40 stops the pressure roller 60 at a predetermined stop position in the aforementioned manner each time in the process of step S150 such that different parts of the pressure roller 60 (also referred to as the backup member) may face the heating member 50. By virtue of this, when carrying out the first heating control a number of times, it is possible to preferably prevent the temperature distribution over the pressure roller 60 from being biased because the different parts of the pressure roller 60 are heated by the heating member 50. Further, although FIG. 5 shows an example of the motor-off temperatures OffT[n] in ascending order as OffT[1]<OffT[2]<OffT[3], the present teaching is not limited to this. Further, the predetermined temperature differences ΔT[n] (ΔT[1], ΔT[2] and ΔT[3]) from the intermediate target temperatures T[1], T[2] and T[3] may as well be set either to be the same, or to differ from each other according to the respective intermediate target temperatures.

Further, the OFF times t2, t5 and t8 of the heater 52 may as well differ from the ON times of the fixation device motor 31. That is, the OFF times t2, t5 and t8 of the heater 52 may as well be set to turn on the fixation device motor 31 by providing a predetermined interval (waiting time) after the OFF times of the heater 52, respectively. Further, the "Motor OFF" in FIG. 5 shows a state that the operation of the fixation device motor 31 or the rotation of the pressure roller 60 is stopped, while the "Motor ON" shows a state that the fixation device motor 31 operates or the pressure roller 60 rotates steadily. Therefore, the motor-on times (the times t2, t5, and the like; corresponding to "rotation start points") refer to the times of starting the rotation of the fixation device motor 31, while the motor-off times (the times t3, t6, and the like) refer to the times of starting the control for stopping the rotation of the fixation device motor 31.

On the other hand, in step S170, when the number of heating repetitions n is "4" (step S170: YES), the repetition control is ended because it exceeds the target number of heating repetitions "3". Then, the CPU 40 carries out the heating (the second heating control) to raise the detection temperature Td to the final target temperature To. That is, the heater 52 is turned on to start namely the PWM control for the heater 52 with the duty cycle of 100% (step S175; at the time t10). Next, the CPU 40 determines whether or not the detection temperature Td is higher than the final target temperature To (step S180).

When the detection temperature Td is determined to be higher than the final target temperature To (step S180: YES), then the CPU 40 turns on the fixation device motor 31 (step S185) and, at the same time, drives the heater 52 in an output control mode (step S190; at the time t11). Here in the output control mode, the duty cycle is controlled such that the detection temperature may be kept at approximately the final target temperature.

Further, the CPU 40 controls the pressure roller 60 to be in a stopped state during the first heating control periods K1, K3, K5, and K7. That is, because the pressure roller 60 is only rotated under the second heating control, it is possible to reduce the maximum power consumption when operating the heating member 50 and the pressure roller 60 simultaneously. As a result, it is possible to reduce the maximum power consumption of the fixation device 30. Further, during the first heating control periods K1, K3, K5, and K7, it is not necessary to control the pressure roller 60 (the fixation device motor 31) to be in a stopped state. For example, during the periods K3, K7, etc., the fixation device motor 31 may as well be turned on.

In the embodiment, the heating control process is carried out in the above manner at the time of startup of the fixation device 30. Further, in the embodiment, an example is shown such that the detection temperature Td is decreased (with a negative change rate of temperature) as by "reducing the change rate of the detection temperature Td" during each of the periods K2, K4, and K6. However, the present teaching is not limited to this. For example, the detection temperature Td may as well be decreased during the period K2, kept constant during the period K4, and controlled during the period K6 to be in a positive change rate of temperature lower than that during the period K5.

5. Effects of the Embodiment

In the embodiment, at the time of startup of the fixation device 30, the intermediate target temperatures T[1], T[2], and T[3] are utilized to control the temperature of the fixation device 30 to rise to the final target temperature To. At the time, the aforementioned second heating control is carried out at least once (during K2, K4, and K6). By the CPU 40 carrying out the second heating control, it is possible to rotate the pressure roller 60 with the fixation device 30 in a state of its temperature rise being diminished, that is, the heating control condition for the fixation device 30 being changed. Therefore, at the time of startup of the fixation device 30, it is possible to change the heating control condition for the fixation device 30 while reducing the bias of temperature distribution toward a specific place of the fixation device 30 (the backup member). Then, when a plurality of intermediate target temperatures are set, it is possible to preferably heat the pressure roller 60 while preventing the bias of temperature distribution over the pressure roller 60, at the time of raising the temperature of the fixation device 30 to the final target temperature To. That is because the plurality of intermediate target temperatures are set in ascending order in accordance with the number of repetitions of the first heating control and the second heating control.

Further, the heating member 50 is a film fixation type, and the grease lubricant G is applied between the fixation film 51 and the nip plate 53 to secure a smooth rotation of the fixation film 51. In this case therefore, it is possible to rotate the pressure roller 60 under the second heating control K2 after the grease lubricant G is warmed to obtain a proper hardness (after being softened) under the first heating control K1. This enables the fixation film 51 to rotate smoothly, thereby avoiding the need to place a large load on the pressure roller 60 for driving the same.

OTHER EMBODIMENTS

The present teaching is not limited to the embodiment explained through the above description and accompanying drawings and, for example, embodiments as follows are also included in the technical scope of the present teaching.

In the embodiment described hereinabove, although an example is shown such that the intermediate target temperatures T[1], T[2], and T[3] serve as the reference temperatures for determining the motor-off temperatures OffT[1], OffT[2], and OffT[3] in step S130, the present teaching is not limited to this. The detection temperature Td at the time of turning on the fixation device motor 31 may also serve as the reference temperature. Further, there are cases that temperature overshoot may occur after the heater 52 is turned off. Therefore, when the fixation device motor 31 is turned on later than the time of turning off the heater, accuracy of the motor-off temperatures OffT[1], OffT[2] and OffT[3] is improved by defining the detection temperature Td at the time of turning on the fixation device motor 31 (at the beginning of rotating the pressure roller 60) as the reference temperature. Further, being not limited to this definition, the motor-off temperatures OffT[1], OffT[2], and OffT[3] may as well be preset temperatures.

In the embodiment described hereinabove, although an example is shown such that the times t2, t5 and t8 of turning off the heater 52 are supposed to be the same as the times of turning on the fixation device motor 31 (the times of rotation start), they are not limited to this configuration. The fixation device motor 31 may as well be turned on (rotation start) after a predetermined time interval from the times of turning off the heater 52.

When the detection temperature Td has dropped predetermined degrees since the time of rotation start of the pressure roller 60 (the time of turning on the fixation device motor 31) after the detection temperature Td reached the intermediate target temperatures T[1], T[2], and T[3] and the second heating control began, then the CPU 40 may carry out the first heating control again. In such a case, it is possible to adjust the heating mode of the fixation device 30 by appropriately setting the predetermined degrees of temperature. Further, it is also possible to reduce the influence of the temperature overshoot occurring after turning off the heater 52.

Further, when the detection temperature Td does not dropped to a predetermined degree, and when a predetermined period of time has elapsed since the time of rotation start of the pressure roller 60 (the time of turning on the fixing device motor 31) after the detection temperature Td reached the intermediate target temperatures T[1], T[2], and T[3] and the second heating control began, then the CPU 40 may detect it as an abnormality with respect to fixation. By such a detection method, it is still possible to preferably detect abnormalities with respect to fixation such as thermistor abnormality, and rotation abnormality of the pressure roller. Further, it is also possible to reduce the influence of the temperature overshoot occurring after turning off the heater 52.

What is claimed is:

1. An image forming apparatus which fixes a developer to form an image on a recording medium, the apparatus comprising:

an image forming section which places the developer on the recording medium to form the image thereon;

a fixation section configured to fix the developer placed on the recording medium to the recording medium, having a heating mechanism configured to generate heat for fixing the developer placed on the recording medium, a roller which is arranged to face the heating mechanism to form a nip portion at which the recording medium is nipped between the roller and the heating mechanism, and a rotation mechanism configured to rotate the roller;

a temperature detector configured to detect a temperature of the fixation section; and a controller configured to control the fixation section in:

a first mode in which the heating mechanism generates heat and the rotation mechanism does not rotate the roller, a second mode in which the heating mechanism does not generate heat and the rotation mechanism rotates the roller, and a third mode in which the heating mechanism generates heat and the rotation mechanism rotates the roller, wherein the controller is configured to change a control mode of the fixation section in the first mode and the second mode periodically at a predetermined interval, during a period in which the temperature of the fixation section detected by the temperature detector is lower than a predetermined value, and wherein the controller is configured to control the fixation section in the third mode, during a period in which the temperature of the fixation section detected by the temperature detector is equal to or higher than the predetermined value.

2. The image forming apparatus according to claim 1, wherein the controller controls the roller to stop rotation under the first mode.

3. The image forming apparatus according to claim 1, wherein the heating mechanism is a film fixation type heating mechanism having a tubular film rotating according to the rotation of the roller, a nip member which nips the film between the nip member and the roller, and a heating source which heats the nip member.

4. The image forming apparatus according to claim 3, wherein the controller detects an abnormality with respect to fixation under a condition that the temperature of the fixation section detected by the temperature detector does not drop under the second mode.

5. The image forming apparatus according to claim 4, wherein the controller detects the abnormality with respect to fixation when the temperature of the fixation section detected by the temperature detector does not drop predetermined degrees within a predetermined period of time.

6. The image forming apparatus according to claim 4, wherein the controller detects the abnormality with respect to fixation under a condition that the temperature of the fixation section detected by the temperature detector does not drop to a predetermined degree although a predetermined period of time has elapsed since a time of starting to rotate the roller after the temperature reached an intermediate target temperature and the second heating control mode began.

7. The image forming apparatus according to claim 6, wherein the intermediate target temperature is set to be lower than a final target temperature.

8. The image forming apparatus according to claim 7, wherein the intermediate target temperature includes a plurality of intermediate target temperatures, and the plurality of intermediate target temperatures are set in ascending order according to a number of repetitions of the first mode and the second mode.

9. The image forming apparatus according to claim 3, wherein the controller carries out the first mode again under a condition that the temperature of the fixation section detected by the temperature detector has dropped predetermined degrees in comparison with the temperature at a time of starting to rotate the roller after the temperature reached an intermediate target temperature and the second mode began.

10. The image forming apparatus according to claim 3, wherein the controller stops the roller so that different parts of the roller face the heating mechanism under a condition that the second mode is performed a number of times.

11. The image forming apparatus according to claim 1, wherein the controller stops power supply to the heating mechanism in the second mode.

12. A heating method of a fixation section of an image forming apparatus at a time of startup of the fixation section which is configured to fix a developer placed on a recording medium to the recording medium and has a heating mechanism configured to generate heat for heating a recording medium on which a developer is placed to form an image, a roller arranged to face the heating mechanism to form a nip portion in which the recording medium is nipped between the roller and the heating mechanism, and a rotation mechanism configured to rotate the roller, the heating method comprising the steps of:

detecting temperature of the fixation section with a temperature detector; and controlling the fixation section in:

a first mode in which the heating mechanism generates heat and the rotation mechanism does not rotate the roller, a second mode in which the heating mechanism does not generate heat and the rotation mechanism rotates the roller, and a third mode in which the heating mechanism generates heat and the rotation mechanism rotates the roller, wherein upon controlling the fixation section, a control mode of the fixation section is changed in the first mode and the second mode periodically at a predetermined interval, during a period in which the temperature of the fixation section detected by the temperature detector is lower than a predetermined value, and wherein upon controlling the fixation section, the fixation section is controlled in the third mode, during a period in which the temperature of the fixation section detected by the temperature detector is equal to or higher than the predetermined value.

13. An image forming apparatus configured to fix a developer to form an image on a recording medium, the apparatus comprising:

an image forming section configured to place the developer on the recording medium to form the image thereon;

a fixation section configured to fix the developer placed on the recording medium to the recording medium, having a heating mechanism configured to generate heat for fixing the developer placed on the recording medium and a roller arranged to face the heating mechanism to form a nip portion at which the recording medium is nipped between the roller and the heating mechanism;

a motor connected to the roller to rotate the roller;

a temperature detector configured to detect a temperature of the fixation section; and a controller configured to control the fixation section in:

a first mode in which the heating mechanism generates heat and the motor does not rotate the roller, a second mode in which the heating mechanism does not generate heat and the motor rotates the roller, and a third mode in which the heating mechanism generates heat and the motor rotates the roller, wherein the controller is configured to change a control mode of the fixation section in the first mode and the second mode periodically at a predetermined interval, during a period in which the temperature of the fixation section detected by the temperature detector is lower than a predetermined value, and wherein the controller is configured to control the fixation section in the third mode, during a period in which the temperature of the fixation section detected by the temperature detector is equal to or higher than the predetermined value.

14. The image forming apparatus according to claim 13, wherein the heating mechanism is a film fixation type heating mechanism having a tubular film rotating according to the rotation of the roller, a nip member which nips the film between the nip member and the roller, and a heating source which heats the nip member.

15. The image forming apparatus according to claim 13, wherein the controller stops the roller so that different parts of the roller face the heating mechanism under a condition that the second mode is performed a number of times.

16. The image forming apparatus according to claim 13, wherein the controller is configured to stop power supply to the heating mechanism in the second mode.

* * * * *